US009415988B2

(12) United States Patent
Leibinger

(10) Patent No.: US 9,415,988 B2
(45) Date of Patent: Aug. 16, 2016

(54) DEVICE FOR FILLING OR EMPTYING A CONTAINER

(71) Applicant: Leibinger GmbH, Teningen (DE)

(72) Inventor: Benedikt Leibinger, Freiburg (DE)

(73) Assignee: Leibinger GmbH, Teningen (DE)

( * ) Notice: Subject to any disclaimer, the term of this patent is extended or adjusted under 35 U.S.C. 154(b) by 0 days.

(21) Appl. No.: 14/440,625

(22) PCT Filed: Oct. 30, 2013

(86) PCT No.: PCT/DE2013/000646
§ 371 (c)(1),
(2) Date: May 5, 2015

(87) PCT Pub. No.: WO2014/071903
PCT Pub. Date: May 15, 2014

(65) Prior Publication Data

US 2015/0284232 A1 Oct. 8, 2015

(30) Foreign Application Priority Data

Nov. 6, 2012 (DE) ..... 10 2012 021 775

(51) Int. Cl.

| | |
|---|---|
| ***B67C 3/10*** | (2006.01) |
| ***B67D 1/04*** | (2006.01) |
| ***B67C 3/02*** | (2006.01) |
| ***B67C 9/00*** | (2006.01) |
| ***B67D 1/08*** | (2006.01) |

(52) U.S. Cl.
CPC ... *B67C 3/10* (2013.01); *B67C 3/02* (2013.01); *B67C 9/00* (2013.01); *B67D 1/045* (2013.01); *B67D 1/0802* (2013.01)

(58) Field of Classification Search
CPC ..... B67D 1/045; B67D 1/0802; B67C 9/00
USPC ..... 141/22–25, 114; 222/386.5, 400.7, 222/464.1, 464.3, 464.5, 95
See application file for complete search history.

(56) References Cited

U.S. PATENT DOCUMENTS

| | | | | |
|---|---|---|---|---|
| 1,977,862 | A * | 10/1934 | Scholtes | B67D 1/045 138/30 |
| 3,306,503 | A | 2/1967 | Page | |
| 3,796,356 | A * | 3/1974 | Venus, Jr. | B65D 83/0061 222/212 |
| 5,667,110 | A | 9/1997 | McCann et al. | |
| 2014/0047797 | A1 | 2/2014 | Leibinger | |

FOREIGN PATENT DOCUMENTS

| | | |
|---|---|---|
| DE | 144794 | 12/1900 |
| DE | 151754 | 5/1903 |
| DE | 3206712 A1 | 9/1983 |
| GB | 2220408 A | 1/1990 |

* cited by examiner

*Primary Examiner* — Mark A Laurenzi
*Assistant Examiner* — Timothy P Kelly
(74) *Attorney, Agent, or Firm* — Gudrun E. Huckett

(57) ABSTRACT

A device for filling or emptying a container (1) containing a liquid particularly intended for consumption has a rod (5) arranged on a holder (4) with a surrounding, balloon-shaped body (6). The length of the rod (5) can be adapted to different distances between the top opening (3) of the container (1) and the base (2) of the container (1).

9 Claims, 3 Drawing Sheets

DEVICE FOR FILLING OR EMPTYING A CONTAINER

BACKGROUND OF THE INVENTION

The invention concerns a device for filling or emptying a container with a liquid that is in particular intended for consumption, comprising a rod arranged on a holder as well as comprising a balloon-type body that is enveloping the rod and is liquid-tight relative to the liquid as well as gas-tight, wherein the rod with the balloon-type body is insertable into an opening of the container and, after complete insertion, the holder is secured on or in the opening of the container, and wherein, after insertion, the balloon-type body is fillable and inflatable with an expansion medium such that the balloon-type body contacts the inner wall surface of the container.

For filling a container, in particular bottle, with a liquid that is intended for consumption, in particular beverage, a balloon-type body that is liquid-tight relative to the liquid as well as gas-tight can be employed. This balloon-type body envelopes in this context a rod which is arranged on the holder. The basic principle for filling the container resides in that first the balloon-type body together with the rod is inserted into the container. The balloon-type body is subsequently inflated with air until it contacts the inner wall surface of the container. Since the balloon-type body that is completely inflated thus completely fills the interior of the container, no air is contained anymore in the container. Subsequently, the air is then discharged again from the balloon-type body. In this way, a gradually increasing space is formed between the balloon-type body and the inner wall surface of the container which is filled with the liquid.

For emptying a container, in particular bottle, which is filled with a liquid that is intended for consumption, in particular beverage and in this connection in particular sparkling wine in connection with bottle fermentation, a balloon-type body can be employed that is liquid-tight relative to the liquid as well as gas-tight. This balloon-type body envelopes in this context a rod which is arranged on a holder. The basic principle for emptying the container resides in that first the balloon-type body together with the rod is inserted into the container. The balloon-type body is subsequently inflated with air so that the gradually increasing volume of the balloon-type body pushes the liquid out of the container until the balloon-type body contacts the inner wall surface of the container. Since finally the completely inflated balloon-type body completely fills the interior of the container, the entire liquid contained in the container has been moved out.

In practical use of this filling or emptying system, the problem resides in that the containers due to their manufacture often have different distances between the top opening of the container and the lower base of the container. This phenomenon occurs, for example, in bottles which have an upwardly curved base. The height of this upwardly curved base is generally different from bottle to bottle due to manufacture. When the base is too low, the rod with its lower end does not completely extend to the base with the consequence that an intermediate space is formed thereat which cannot be filled out with the balloon-type body. When the base is however too high, the rod as a whole is too long so that the upper holder of the rod cannot properly be seated on the opening of the container. Or, when the insertion force of the rod into the container is too great, damages may even occur.

Based on this, it is therefore the object of the invention to provide a device for filling or for emptying a container with a liquid that is in particular intended for consumption, which can even be employed in connection with containers whose bases are different high.

SUMMARY OF THE INVENTION

The technical solution is characterized in that the distance between the lower end of the rod and the upper holder is automatically changeable depending on the distance between the lower base and the top opening of the container.

In this way, a device for filling or for emptying a container with a liquid that is in particular intended for consumption is provided which can be used reliably even when the containers to be filled have bases with different heights such that accordingly the distance between the opening of the container and the base of the container varies. The gist of the invention resides in this context in that the rod which is projecting into the interior of the container does not have a predetermined constant length but that the length of the rod is variable so that the system can automatically adjust to differently high bases. In this way, it is ensured that, on the one hand, after inflation of the balloon-type body the interior of the container is completely filled out by this balloon-type body and in that, on the other hand, in case of bases that are too high no damages may occur, wherein the holder is always seated in the predetermined position on the opening of the container. The automatic adjustability of the length of the rod has thus the advantage that in a very safe and technically simple way a problem-free filling or emptying of containers is possible According to one embodiment, the rod is designed to be telescoping. This means that the rod is of a multi-part configuration wherein the rod elements can be pulled apart in a telescoping way as well as—in reverse—can be pushed together. Due to the telescoping action, the length of the rod can be changed very simply or the length of the rod changes automatically during its use. The telescoping action is to be understood in a general sense.

In a first embodiment of the telescoping action, a sleeve is pushed onto the lower end of the rod. This sleeve defines therefore the lower end of the rod. By displacement of the sleeve on the actual rod, the length of the latter is changed.

An alternative thereto proposes that the lower end of the rod is designed to be tubular, wherein a bar is guided in the interior of this lower tube section. This means that, in this embodiment variant, the bar projects from the lower end of the rod. Of course, the bar can have an appropriate impact body at the lower end.

As an alternative to the described telescoping action of the rod, the rod can be longitudinally moveable in its holder. This means that this is based on a rod which has a constant length from its lower end to its upper end. Since however this rod is longitudinally moveable within the holder, the distance between the holder and the lower end of the rod can be changed in this way. For example, when the distance is to be reduced, the rod is pulled out of the holder. In reverse, for enlargement of the distance, the rod is moved in the opposite direction.

Another embodiment proposes that the lower end of the balloon-type body is attached to the lower end of the rod. In this context, the elements of the rod, in case of a possible telescoping action, are freely movable (thus, for example, without an additional spring force). Or, when the rod has a constant length, it is also guided to be freely longitudinally movable within the upper holder, without the effect of a spring force, for example. This is so because the basic idea resides in that, due to the attachment of the lower end of the balloon-type body to the lower end of the rod, upon inflation of the balloon-type body a force is acting automatically in the longitudinal direction of the rod and extends the latter in a telescoping fashion or moves it deeper into the container—for a longitudinal slidable support in the holder—until the lower end of the rod impacts on the base of the container. In the end, this means that essentially the balloon-type body is acting as an adjustment element for changing the distance between the holder for the rod and the lower end of the rod. When the air is discharged again from the balloon-type body, an effect in the opposite direction occurs, i.e., the rod is retracted again.

An alternative thereto is proposed where a spring is used which maximally extends the rod in the initial position. When the rod is now inserted into the container, at some point the lower end of the rod impacts on the base of the container. Up to the point of final contact of the holder on the opening of the container, the distance between the holder and the lower end of the rod permanently decreases, wherein the lower end of the rod permanently contacts the base of the container. In this embodiment, the lower end of the balloon-type body can also be fixedly connected with the lower end of the rod. The balloon-type body is therefore secured with its lowest location on the lower end of the rod. The "rod" is to be understood in this context as the entity comprised of the actual rod and a possible extension element.

BRIEF DESCRIPTION OF THE DRAWINGS

Embodiments of the device according to the invention for filling or for emptying a container with a liquid that is in particular intended for consumption will be described in the following with the aid of the drawings. They show in.

DESCRIPTION OF PREFERRED EMBODIMENTS

Figure 1C:
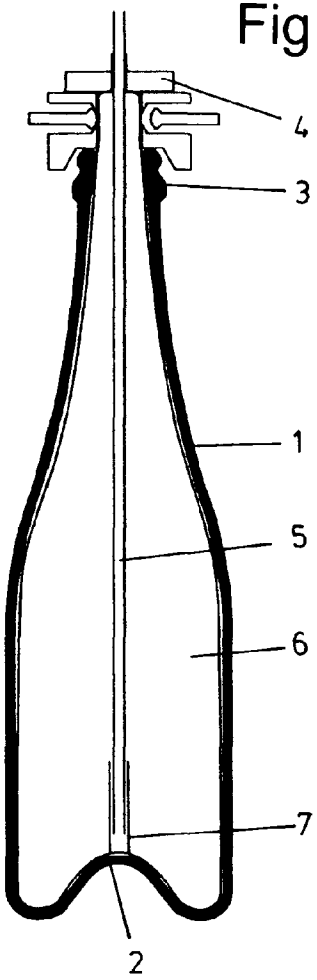
FIG. 1*c* an illustration according to FIG. 1*b* but with a bottle with a higher base.

A container 1 in the form of a bottle comprises a lower base 2 as well as an top opening 3. The base 2 is upwardly curved in this context.

This container 1 is to be filled with a liquid, i.e., a beverage. Alternatively, in the container 1 there is already a liquid which is to be emptied from the container 1.

In the following, first the case of filling of the container 1 is illustrated and described.

For filling the container 1, a filling device is provided. It is comprised first of an upper holder 4 which is placed onto the opening 3 of the container 1. A rod 5 is arranged at this holder 4 and projects downwardly. Finally, a balloon-type body 6 is provided which is pulled over the rod 5 and is also secured on the holder 4 with its upper end and is attached with its lower end to the lower end of the rod 5.

The special feature of this system is that a sleeve 7 is pushed onto the lower end of the rod 5. The lower end of the balloon-type body 6 is attached—as explained—to the lower end of this sleeve 7 that is freely slidable on the rod 5.

The function for filling the container 1 is as follows.

After the filling device with its rod 5 and the balloon-type body 6 has been inserted from above through the opening 3 into the container 1 such that the holder 4 is placed onto the opening 3 of the container 1 in the prescribed position, the balloon-type body 6 is filled with air and correspondingly inflated. The supply of air can be realized through the—then tubularly designed—rod 5 by means of appropriate openings or through the holder 4. The situation prior to complete inflation of the balloon-type body 6 is illustrated in FIG. 1*a*.

Since the base 2 of the container 1 is relatively low, as a result of the inflation movement of the balloon-type body 6, the sleeve 7 on the rod 5 is moved downwardly until the lower end of the sleeve 7 impacts on the base 2. The situation is illustrated in FIG. 1*b*.

This means that, as a result, the balloon-type body 6 completely fills out the interior of the container 1 and there is thus no intermediate space anymore in the container 1 between the balloon-type body 6 and the inner wall of the container 1 which is filled with air. Subsequently, air is again discharged from the balloon-type body 6. The thus provided space within the container 1 is filled with the liquid, namely without the liquid having come into contact with any air. Finally, the balloon-type body 6 is pulled out of the container 1 again.

Figure 1B:
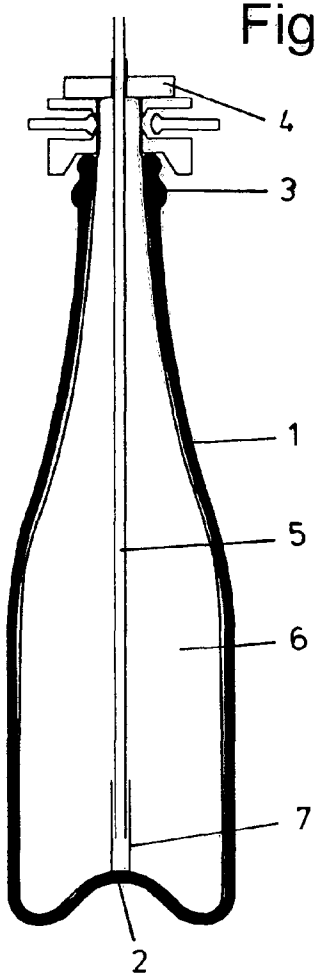
FIG. 1*b* an illustration corresponding to that of FIG. 1*a* after complete inflation of the balloon-type body.
Figure 1A:
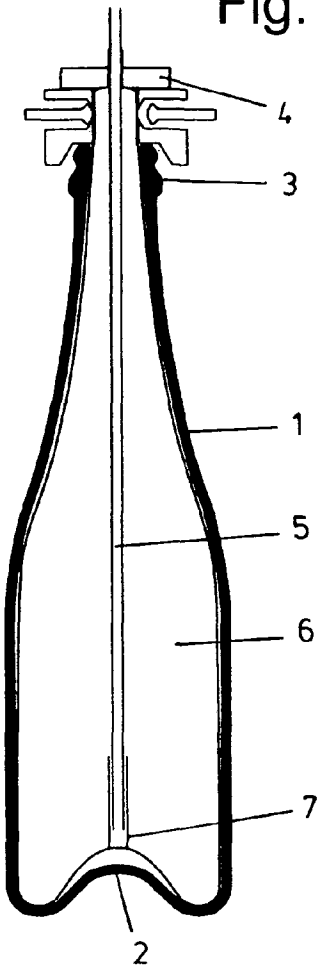
FIG. 1*a* a schematic section illustration of a container in the form of a bottle after positioning of the filling or emptying device, wherein the final position with complete inflation of the balloon-type body has not yet been reached.

FIG. 1*c* shows the situation of a container 1 whose base 2 is higher than the base 2 in the embodiment of FIGS. 1*a* and 1*b*. This means that in this case of the higher base 2, the sleeve 7 is not moved as far downwardly along the rod 5 as in the afore described embodiments. The sleeve 7 thus defines a length compensation between the top opening 3 and the lower base 2 of the container 1 with regard to the length of the rod 5.

In the illustrated embodiment, the sleeve 7 is moved on its rod 5 due to the inflation movement of the balloon-type body 6. It is however also conceivable that a spring is arranged—not illustrated—between the rod 5 and the sleeve and moves the sleeve 7 into the maximally extended position. This position defines the maximum length of the rod system.

When here the filling device with rod 5 and sleeve 7 as well as with balloon-type body 6 is then inserted into the container 1, the lower end of the sleeve 7 will contact the base 2 in any case. Against the spring force, the sleeve 7 is then moved back again until the holder 4 comes to rest properly on the opening 3 of the container 1. How far the sleeve 7 is moved back against the spring force depends on the height of the base 2. In the embodiment of FIG. 1*b* with the relatively low base 2, the return movement of the sleeve 7 is less than in the embodiment of FIG. 1*c* in which the base 2 is higher and the sleeve 7 is thus pushed back more strongly.

The situation for emptying the container 1 is as follows:

The container 1 contains a liquid. The latter is to be conveyed out of the container 1. For this purpose, the balloon-type body 6 with its rod 5 is inserted and inflated with air. The supply of air in this case can be realized through the—then tubularly embodied—rod 5 by means of appropriate openings or through the holder 4. In this way, the liquid contained within the container 1 is pushed out through the top opening 3 of the container 1 via appropriate discharge openings in the holder 4.

Here, during emptying of the container 1, the situation may occur that the bases 2 of the containers 1 have different heights due to manufacture. Due to the length compensation by means of the sleeve 7, a safe emptying even of containers 1 with differently high bases 2 is possible because the length of the rod 5 is adjusted. The constructive configurations for movement of the sleeve 7, as it has been explained above in connection with filling of the container 1, are provided here accordingly.

Figure 2B:
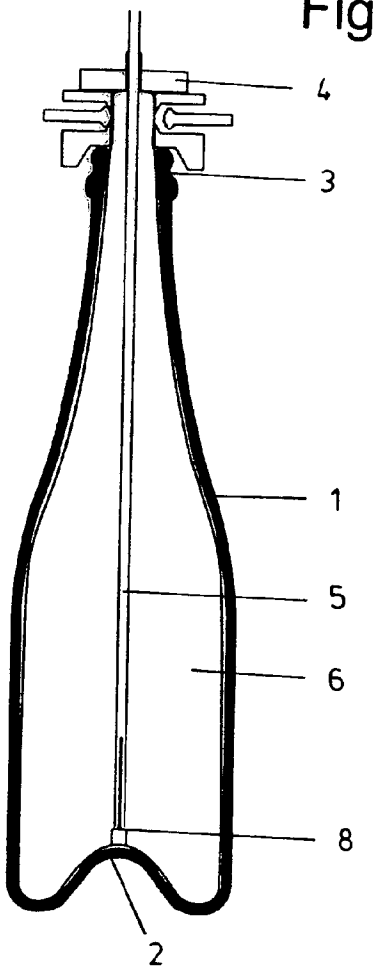
FIGS. 2*a* and 2*b* an illustration in accordance to that of FIGS. 1*b* and 1*c* with lower and higher base in a second embodiment of the filling or emptying system.
Figure 2A:
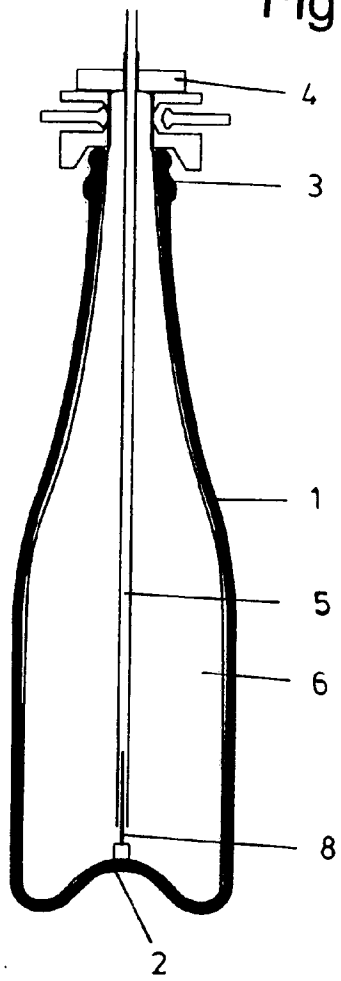

The second embodiment of the filling and emptying device is illustrated in FIGS. 2*a* and 2*b*. The basic principle is the same as in the first embodiment in FIGS. 1*a* to 1*c*, except that, instead of the sleeve 7, a small bar 8 is provided which is guided within the lower tubular end of the rod 5. This bar 8 can be guided freely in the rod 5 or a spring is arranged between the rod 5 and the bar 8 which moves the bar 8 maximally outwardly due to the spring force. The basic function corresponds in this context to the function of the first embodiment of FIGS. 1*a* to 1*c*.

Figure 3B:
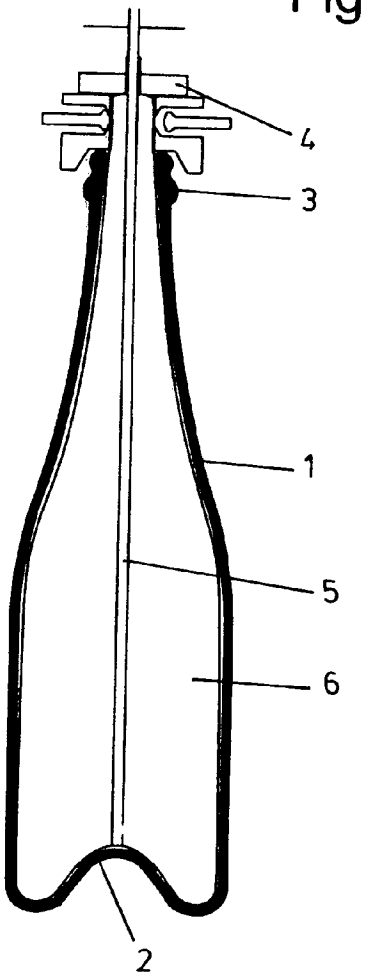
FIGS. 3*a* and 3*b* an illustration corresponding to that of FIGS. 1*b* and 1*c* with lower and higher base in a third embodiment of the filling or emptying system.
Figure 3A:
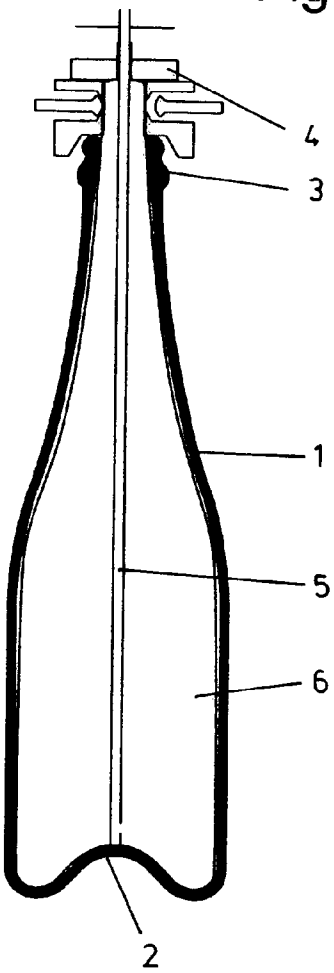

A third embodiment is illustrated in FIGS. 3*a* and 3*b*. In this embodiment, the rod 5 has a constant length and, in contrast to the embodiment of FIGS. 1*a* to 1*c*, is not extendable by a sleeve or, in contrast to the embodiment of FIGS. 2*a* and 2*b*, by a bar 8. Instead, the upper end of the rod 5 is movably supported within the holder 4. This can be realized in that either through the inflation of the balloon-type body 6 the rod 5 is moved downwardly until it impacts on the base 2 of the container 1 or in that, between the holder 4 and the rod 5, a spring device is arranged which, in the initial position, moves the rod 5 maximally downwardly until it impacts on the base 2 of the container 1 and thereby is moved back. Accordingly, the basic principle of this function corresponds to the functions as explained in connection with the embodiments of FIGS. 1*a* to 1*c* as well as 2*a* and 2*b*.

In this context, FIG. 3*a* shows the situation for a low base 2 while FIG. 3*b* shows the situation with a higher base 2 in which the rod 5 is not moved so deep into the container 1 because it impacts beforehand on the higher base 2.

As has already been explained above, the lower end of the balloon-type body 6 is attached to the lower end of the rod 5. In this way, there is not the risk that the rod 5 can push through the balloon-type body 6. This case could indeed occur in case of a loose arrangement of the balloon-type body 6 on the rod 5. In contrast thereto, due to the attachment of the balloon-type body 6 on the lower end of the rod 5 according to the invention, this rod 5 is extended in a controlled fashion by inflation of the balloon-type body 6.

LIST OF REFERENCE CHARACTERS

1 container
2 base
3 opening
4 holder
5 rod
6 balloon-type body
7 sleeve
8 bar

What is claimed is:

1. A device for filling or for emptying a container with a liquid, the device comprising:

a holder;

a rod assembly comprising a rod having a first end arranged on the holder and a second end opposite the first end remote from the holder;

a balloon body enveloping the rod, wherein the balloon body is liquid-tight and gas-tight and is fastened with an upper end to the holder;

wherein the rod together with the balloon body is configured to be inserted into an opening of the container and the holder is configured to be secured on or in the opening of the container after insertion of the rod and the balloon body;

wherein, after insertion, the balloon body is configured to be filled and inflated with an expansion medium such that the balloon body contacts an inner wall surface of the container;

wherein a first distance between the second end of the rod and the holder is automatically changeable depending on a second distance between a base of the container and a top opening of the container;

wherein the rod assembly is a telescoping rod assembly further comprising a sleeve slidably arranged on the second end of the rod.

2. The device according to claim 1, wherein the balloon body comprises a lower end attached to the second end of the rod.

3. The device according to claim 2, wherein the first distance between the second end of the rod and the holder is increased by inflating the balloon body with the expansion medium and is decreased by discharging the expansion medium from the balloon body.

4. A device for filling or for emptying a container with a liquid, the device comprising:

a holder;

a rod assembly comprising a rod having a first end arranged on the holder and a second end opposite the first end remote from the holder;

a balloon body enveloping the rod, wherein the balloon body is liquid-tight and gas-tight and is fastened with an upper end to the holder;

wherein the rod together with the balloon body is configured to be inserted into an opening of the container and the holder is configured to be secured on or in the opening of the container after insertion of the rod and the balloon body;

wherein, after insertion, the balloon body is configured to be filled and inflated with an expansion medium such that the balloon body contacts an inner wall surface of the container;

wherein a first distance between the second end of the rod and the holder is automatically changeable depending on a second distance between a base of the container and a top opening of the container;

wherein the rod assembly is a telescoping rod assembly further comprising a bar, wherein the second end of the rod is tubular, and wherein the bar is arranged so as to be longitudinally slidable in the tubular second end of the rod.

5. The device according to claim 4, wherein the balloon body comprises a lower end attached to the second end of the rod.

6. The device according to claim 5, wherein the first distance between the second end of the rod and the holder is increased by inflating the balloon body with the expansion medium and is decreased by discharging the expansion medium from the balloon body.

7. A device for filling or for emptying a container with a liquid, the device comprising:

a holder;

a rod assembly comprising a rod having a first end arranged on the holder and a second end opposite the first end remote from the holder;

a balloon body enveloping the rod, wherein the balloon body is liquid-tight and gas-tight and is fastened with an upper end to the holder;

wherein the rod together with the balloon body is configured to be inserted into an opening of the container and the holder is configured to be secured on or in the opening of the container after insertion of the rod and the balloon body;

wherein, after insertion, the balloon body is configured to be filled and inflated with an expansion medium such that the balloon body contacts an inner wall surface of the container;

wherein a first distance between the second end of the rod and the holder is automatically changeable depending on a second distance between a base of the container and a top opening of the container;

wherein the rod comprises an initial position in which the rod is loaded by a spring force to have a maximum value of the first distance between the second end of the rod and the holder, wherein the second end of the rod, when the second end impacts on the base of the container, is pushed back by the base of the container against the spring force from the initial position into a second position in which the first distance between the second end of the rod and the holder is reduced relative to the maximum value.

8. The device according to claim 7, wherein the rod is longitudinally slidably guided within the holder.

9. The device according to claim 7, wherein the balloon body comprises a lower end attached to the second end of the rod.

* * * * *